US010092949B2

(12) United States Patent
Katsumura et al.

(10) Patent No.: US 10,092,949 B2
(45) Date of Patent: Oct. 9, 2018

(54) METHOD OF MANUFACTURING ROUND STEEL BILLET

(71) Applicant: JFE STEEL CORPORATION, Tokyo (JP)

(72) Inventors: Tatsuro Katsumura, Handa (JP); Hirohide Uehara, Chiba (JP); Yoichi Ito, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 302 days.

(21) Appl. No.: 15/039,547

(22) PCT Filed: Nov. 14, 2014

(86) PCT No.: PCT/JP2014/005724
§ 371 (c)(1),
(2) Date: May 26, 2016

(87) PCT Pub. No.: WO2015/079639
PCT Pub. Date: Jun. 4, 2015

(65) Prior Publication Data

US 2017/0333983 A1 Nov. 23, 2017

(30) Foreign Application Priority Data

Nov. 29, 2013 (JP) ..... 2013-246990

(51) Int. Cl.
*B22D 11/22* (2006.01)
*B22D 11/124* (2006.01)
*B22D 11/128* (2006.01)

(52) U.S. Cl.
CPC ..... *B22D 11/225* (2013.01); *B22D 11/124* (2013.01); *B22D 11/1287* (2013.01)

(58) Field of Classification Search
CPC . B22D 11/1206; B22D 11/124; B22D 11/128; B22D 11/1287; B22D 11/225
(Continued)

(56) References Cited

U.S. PATENT DOCUMENTS 5,497,821 A * 3/1996 Arvedi ..... B22D 11/1206 164/417
6,241,004 B1 * 6/2001 Ebisu ..... B22D 11/122 164/466
7,121,323 B2 * 10/2006 Weyer ..... B22D 11/1206 164/476

FOREIGN PATENT DOCUMENTS

CN 1219896 A 6/1999
CN 101406940 A 4/2009
(Continued)

OTHER PUBLICATIONS

Chinese Office Action for Chinese Application No. 201480065059.7, dated Feb. 6, 2017, including Concise Statement of Search Report, 7 pages.
(Continued)

*Primary Examiner* — Kevin E Yoon
(74) *Attorney, Agent, or Firm* — RatnerPrestia

(57) ABSTRACT

A method of manufacturing a round steel billet by continuous casting includes a local cooling step where inhomogeneous forced cooling is applied to a cast product during the continuous casting, and a rolling reduction step where rolling reduction is applied to the cast product in the opposite directions of the polar opposites by reduction rolls in the course from the completion of solidification to the completion of the recuperation of the cast product so that rolling reduction r which is a reduction ratio of a distance between middle points of the polar opposites is set to a value exceeding 0% and 5% or less.

4 Claims, 3 Drawing Sheets

(58) Field of Classification Search
USPC ..... 164/476, 485, 486
See application file for complete search history.

(56) References Cited

FOREIGN PATENT DOCUMENTS

| | | | | | |
|---|---|---|---|---|---|
| CN | 102527975 | B | | 10/2013 | |
| EP | 0909598 | A1 | | 4/1999 | |
| JP | 61038761 | A | * | 2/1986 | ..... B22D 11/128 |
| JP | 03124352 | | | 5/1991 | |
| JP | 08150451 | A | | 6/1996 | |
| JP | 10156495 | | | 6/1998 | |
| JP | 2947098 | B2 | | 9/1999 | |
| JP | 11267814 | | | 10/1999 | |
| JP | 2004330252 | | | 11/2004 | |
| JP | 2006095565 | | | 4/2006 | |
| JP | 2011136363 | | | 7/2011 | |
| JP | 2012218035 | A | | 11/2012 | |
| JP | 2013180307 | A | | 9/2013 | |

OTHER PUBLICATIONS

Supplementary European Search Report for Application No. 14866338.8, dated Sep. 15, 2016, 4 pages.
International Search Report and Written Opinion of the International Searching Authority for International Application No. PCT/JP2014/005724 dated Jan. 27, 2015.
Japanese Notice of Allowance with partial English language translation for Application No. JP 2013-246990, dated Mar. 24, 2015, 4 pages.

* cited by examiner

| PORTION | STRESS (MPa) |
|---|---|
| a | 0~9 |
| b | 9~18 |
| c | 18~26 |
| d | 26~35 |

(POSITIVE: TENSILE STRESS
NEGATIVE: COMPRESSIVE STRESS)

| PORTION | STRESS (MPa) |
|---|---|
| a | 0~-9 |
| b | -9~-18 |
| c | -18~-26 |
| d | -26~-35 |
| e | -35~-44 |
| f | -44~-53 |
| g | -53~-61 |
| h | -61~-70 |

(POSITIVE: TENSILE STRESS
NEGATIVE: COMPRESSIVE STRESS)

METHOD OF MANUFACTURING ROUND STEEL BILLET

CROSS-REFERENCE TO RELATED APPLICATIONS

This is the U.S. National Phase application of PCT/JP2014/005724, filed Nov. 14, 2014, and claims priority to Japanese Patent Application No. 2013-246990, filed Nov. 29, 2013, the disclosures of each of these applications being incorporated herein by reference in their entireties for all purposes.

FIELD OF THE INVENTION

The present invention relates to a method of manufacturing a round steel billet. "Round steel billet" means a steel billet having a circular transverse cross section.

BACKGROUND OF THE INVENTION

To apply a continuous cast product to a round steel billet which is used for manufacturing a high Cr steel (steel containing a large content of Cr) such as a 13Cr steel, it is desirable that the continuous cast product for round steel billet has sound inner quality comparable to inner quality of a blooming mill product for round steel billet.

In a continuous casting process, in general, segregation occurs in the steel billet due to concentrated molten steel which remains in an axial core area of the steel billet (indicating a circle having a radius of (D/2)×0.2 about an axis in a cross section of the steel billet having an outer diameter D and an area inside the circle). Also porosity is generated in the steel billet due to shrinkage of the finally solidified axial core area. Accordingly, it is difficult for the round steel billet by the continuous casting process to have sound inner quality comparable to inner quality of the round steel billet by the blooming mill process. Particularly, the round steel billet used for manufacturing a seamless steel pipe or tube by roll piercing such as Mannesmann piercing is required to have sufficient workability. Accordingly, to apply the continuous cast product to the round steel billet, it is necessary to take measures to decrease segregation and porosity in the axial core area as much as possible.

As one of the above-mentioned measures, for example, there has been known a method which reduces a cross-section area of the cast product by adding rolling reduction to the unsolidified area in the inside of the cast product using rolls having a diameter 2 to 5 times as large as a thickness of the cast product, that is, the bloom or the billet during a terminal period of solidification in the course of continuous casting and, at the same time, by eliminating unsolidified molten steel in which impurity elements are concentrated from the axial core area of the cast product (patent literature 1, for example).

As an another countermeasure, there has been known a method where the cast product which is completely solidified is formed to have a predetermined cross-section shape by applying roll forming following the above-mentioned rolling reduction applied to the unsolidified area and, in such a stage, preferably, the surface of the cast product is cooled with a predetermined water volume from the completion of the rolling reduction to the starting of the roll forming (patent literature 2, for example).

On the other hand, there has been known a method where quality of the axial core area of the cast product is enhanced by controlling a secondary cooling condition of the cast product in the course of continuous casting within a specified range with respect to a steel having a specified chemical composition (patent literature 3, patent literature 4, patent literature 5, and the like, for example). In patent literature 4, casting speed is also specified. Further, in patent literature 5, it is described that electromagnetic stirring may be applied to the unsolidified area of the cast product.

PATENT LITERATURE

[PTL 1] Japanese Patent Application Publication No. 3-124352

[PTL 2] Japanese Patent Application Publication No. 11-267814

[PTL 3] Japanese Patent Application Publication No. 2006-95565

[PTL 4] Japanese Patent Application Publication No. 2011-136363

[PTL 5] Japanese Patent Application Publication No. 2004-330252

SUMMARY OF THE INVENTION

However, with respect to the measures disclosed in patent literatures 1 and 2 where the unsolidified area is subjected to rolling reduction, since it is practically difficult to coincide the installation position of a facility which performs such rolling reduction with the axial core direction position of the cast product which is brought into solidification, it is difficult to acquire a sufficient effect of improving quality of the axial core area of the cast product.

On the other hand, with respect to the measures disclosed in patent literatures 3 to 5 where the secondary cooling condition is controlled, although the axial core area of the cast product which is the finally solidified area receives a tensile stress generated by solidification shrinkage so that cracks occur in the axial core area or large porosity is generated in the axial core area, the occurrence of such defects can be suppressed by reinforcing or optimizing water cooling of the cast product from the outside. Although these countermeasures are not effective at the same level as the rolling reduction of the unsolidified area, these countermeasures exhibit such a defect suppression effect to some extent. Further, when such countermeasures are taken, with water cooling from the outside, a cooling zone can be installed relatively easily, and a control of the cooling zone can be relatively easily performed and hence, these countermeasures have excellent industrial practicality. However, although it is considered preferably that the outer peripheral surface of the cast product is water cooled uniformly usually, it is difficult to satisfy such a preferable water cooling condition. For example, it is unavoidable that cooling power differs among portions at different circumferential locations in cross section such as between a portion which directly receives oncoming discharge cooling water and a portion which does not receive such oncoming discharge cooling water or between a portion which receives cooling water discharged from different discharge holes in an overlapping manner and a portion which does not receive such cooling water (that is, unequal cooling occurs in the circumferential direction in the cross section of the cast product). When the cooling power differs, a tensile stress is inevitably generated in the axial core area of the cast product eventually.

The steels disclosed in patent literatures 3 to 5 do not contain Cr, or even when these steels contain Cr, the content of Cr is 3 mass % at maximum. On the other hand, according to studies made by the inventors of the present invention, particularly, the high Cr steel such as a 13Cr steel exhibits more apparently a tendency that the generation of the above-mentioned tensile stress leads to the defect generation of the axial core area of the cast product compared to the steel where the content of Cr is 3 mass % or less.

Accordingly, the prior arts have a drawback that it is difficult to produce a round steel billet having an axial core area where quality is sufficiently sound for manufacturing a seamless steel pipe, and particularly a seamless steel pipe made of high Cr steel, using a continuous casting process.

The inventors of the present invention have made intensive studies to overcome the above-mentioned drawback. As a result, the inventors have made a finding that in manufacturing a round steel billet by continuous casting, the performance in which polar opposites on an outer periphery of a cast product in a specified state in the course of casting are intentionally cooled by forced cooling more strongly than remaining portions other than the polar opposites and, thereafter, rolling reduction is applied to the cast product by setting opposite directions of polar opposites as rolling reduction directions is effective in the improvement of quality of the axial core area of the cast product, and the inventors have made the present invention based on such a finding.

Here, the above-mentioned polar opposites on the outer periphery indicate both of an outer periphery which intersects with an angle domain having a center angle θ about an axial core in a plane including a transverse cross section which is a cross section perpendicular to an axial direction of the cast product, and an outer periphery which intersects with an angle domain which half-turns from the angle domain about the axial core. FIG. 2 is a schematic view showing the definition of the polar opposites. As shown in the drawing, both of the outer periphery which intersects with the angle domain K1 having the center angle θ about the axial core 10C within the plain 11 including the transverse cross-section of the cast product 10 and the outer periphery which intersects with the angle domain K2 which half-turns from the above-mentioned angle domain K1 about the axial core 10C are defined as polar opposites 2. Further, remaining portions obtained by removing polar opposites 2 from the whole outer periphery in the transverse cross-section are remaining portions 3. From a viewpoint of acquiring an apparent effect of improving quality of the axial core area of the cast product, it is necessary to set the above-mentioned center angle θ to a value exceeding 0 degree and 120 degrees or less. It is preferable to set the center angle θ to 10 degrees or more and 90 degrees or less.

That is, aspects of the present invention are directed to the following.

(1) A method of manufacturing a round steel billet by continuous casting which includes:

a local cooling step where inhomogeneous forced cooling is applied to a cast product during the continuous casting in such a manner that the inhomogeneous forced cooling cools polar opposites on an outer periphery of the cast product defined by the following (A) more strongly than remaining portions of the cast product other than the polar opposites, the inhomogeneous forced cooling is started at a point of time within a terminal period of solidification defined by the following (B) and is stopped when a temperature of an axial core falls within a temperature range from a temperature below a solidification point to the solidification point minus 190° C., and a temperature deviation δ which is a maximum value of surface temperature difference between the polar opposites and the remaining portions at the time of completion of recuperation after the forced cooling is stopped is set to 10° C. or above; and a rolling reduction step where rolling reduction is applied to the cast product in the opposite directions of the polar opposites by reduction rolls in the course from the completion of solidification to the completion of the recuperation of the cast product so that rolling reduction r which is a reduction ratio of a distance between the middle points of the polar opposites is set to a value exceeding 0% and 5% or less.

Note (A) Polar opposites on the outer periphery indicate both an outer periphery which intersects with an angle domain having a center angle θ exceeding 0 degree and 120 degrees or less about an axial core in a plane including a transverse cross-section of the cast product, and an outer periphery which intersects with an angle domain obtained by rotating the angle domain by 180 degrees about the axis core.

(B) The terminal period of solidification is a period where a solidification rate at the center becomes 0.5 or more and 1.0 or less.

(2) The method of manufacturing a round steel billet described in (1), wherein the temperature deviation δ is set to 30° C. or below.

(3) The method of manufacturing a round steel billet described in (1) or (2), wherein the rolling reduction r is set to 1% or more and 3% or less.

According to aspects of the present invention, the tensile stress field directed in the opposite directions of polar opposites is generated at portions away from the axial core of the cast product due to the above-mentioned local cooling step, and the tensile stress field can be converted into the compression stress field which substantially covers the whole cross-section of the cast product by the above-mentioned rolling reduction step. Accordingly, it is possible to prevent the tensile stress field attributed to the local cooling which becomes a cause of inducing a defect such as a straight line crack in the axial core area from remaining in the cast product and hence, quality of the axial core area of the cast product can be largely enhanced. As a result, the round steel billet, particularly, the round steel billet for manufacturing a seamless steel pipe made of high Cr steel can be manufactured with high quality by continuous casting.

Further, according to aspects of the present invention, a local cooling facility and a roll reduction facility have a large degree of freedom in installation position, and a complicated control is also unnecessary so that the round steel billet can be manufactured easily.

DETAILED DESCRIPTION OF EMBODIMENTS OF THE INVENTION

Figure 1:
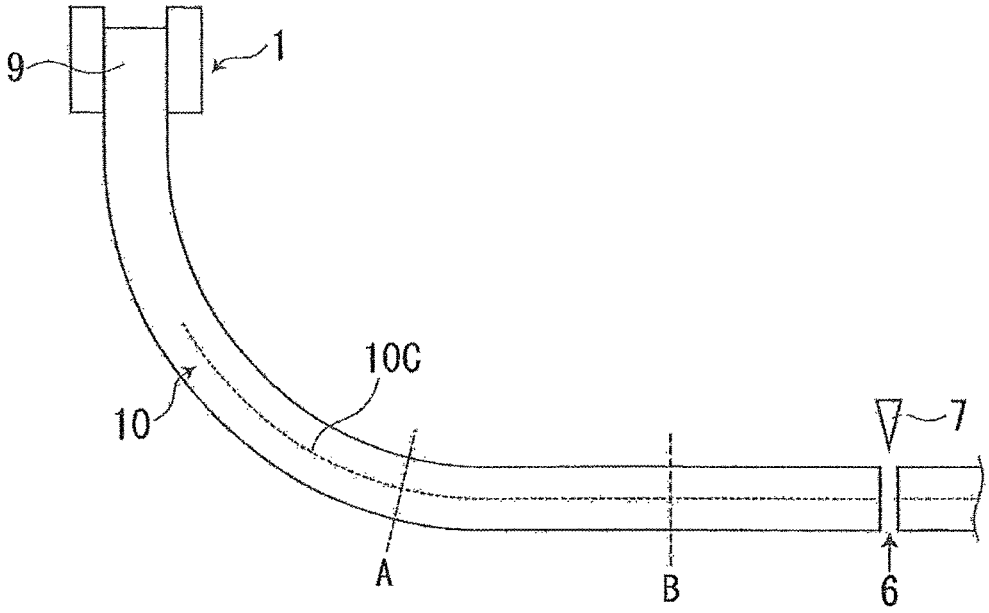
FIG. 1 is a schematic view showing one example of embodiments of the present invention.

FIG. 1 is a schematic view showing one example of embodiments of the present invention. Molten steel 9 is tapped into the cylindrically-shaped inside of a casting mold (continuous casting mold) 1 from a submerged nozzle (not shown in the drawing). The molten steel 9 in the mold 1 is cooled from an inner surface of the mold 1 so that a solidified shell (not shown in the drawing) is formed on an outer peripheral surface layer. Thereafter, a cast product 10 is continuously drawn out downward from the mold 1 and, then, is subjected to solidification promotion by forced cooling of an outer surface of the cast product 10 or by air cooling or the cast product 10 is cooled after solidification. While being cooled in the above-mentioned manner, the cast product 10 is transferred by transfer rolls (not shown in the drawing) to a gas cutting point 6 where a temperature of an axial core 100 of the cast product 10 becomes approximately 500° C. or below, and the cast product 10 is cut into a desired length by a gas torch 7 installed at the gas cut point 6.

A degree of development of solidification is expressed by a center solid-phase rate. The center solid-phase rate is an amount defined by a ratio (range of value: 0 to 1) of a solid phase mass with respect to a total mass of the solid phase mass and a liquid phase mass in a coexisting state in an axial core area of the cast product drawn out from the mold. A value of the center solid-phase rate can be obtained by using a calculated temperature of an axial core area of the cast product obtained by a heat-transfer solidification analysis (to be more specific, defined as a calculated temperature obtained by averaging terriperatures with respect to all elements (all calculation points) within a radius of 5 mm from the center of the cast product (hereinafter referred to as "axial core temperature")) and a liquidus-line temperature and a solidus-line temperature intrinsic to the steel.

In FIG. 1, a position A corresponds to any one point in the terminal period of solidification which is a starting point of the above-mentioned inhomogeneous forced cooling. A position B corresponds to any one point within a temperature region which is a stop point of the inhomogeneous forced cooling where an axial core temperature becomes a temperature which is below a solidifying point and above a temperature lower than a solidifying point minus ΔT (ΔT=190° C.) in this embodiment.

The method of manufacturing a round steel billet according to aspects of the present invention has a local cooling step and a rolling reduction step.

Figure 3:
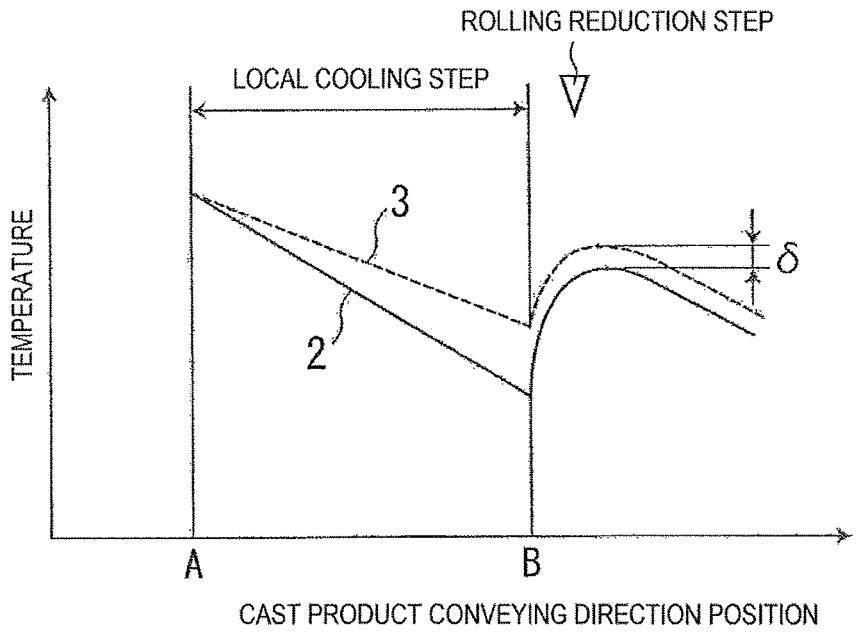
FIG. 3 is a schematic view showing a temperature history of cast product in a local cooling step.

The local cooling step is, as shown in FIG. 3, a step where the above-mentioned inhomogeneous forced cooling is performed between the above-mentioned positions A and B and, then, the inhomogeneous forced cooling is stopped and, thereafter, the temperature deviation S which is a maximum value of an amount obtained by subtracting a temperature of polar opposites 2 at a point of time that the recuperation during natural cooling is completed from a temperature of the remaining portions 3 at a point of time when the recuperation during natural cooling is completed (that is, a maximum value of a temperature of the remaining portions 3 at a point of time when recuperation is completed—a minimum value of a temperature of polar opposites 2 at a point of time when recuperation is completed) becomes 10° C. or above.

Figure 2:
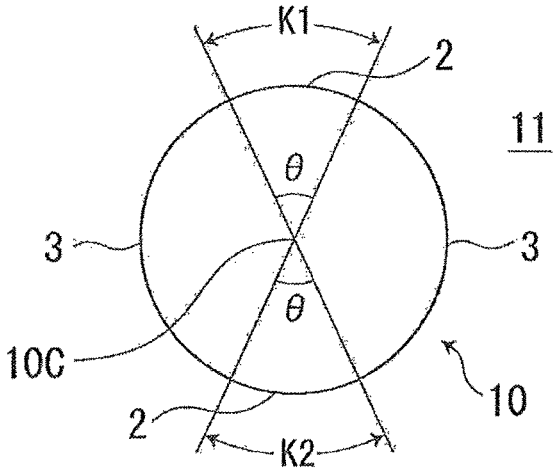
FIG. 2 is a schematic view showing the definition of polar opposites.
Figure 4:
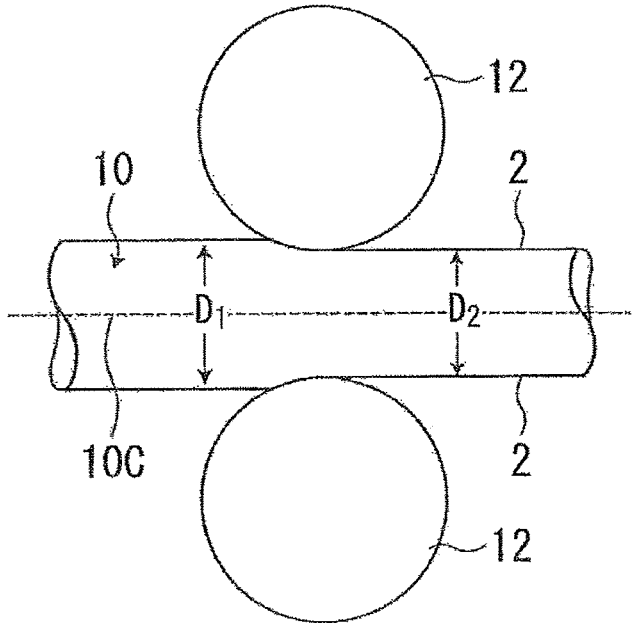
FIG. 4 is a schematic view showing a cross section of cast product in an axial direction showing an embodiment of a rolling reduction step.

The rolling reduction step is a step where, in the course from the completion of solidification of the cast product to the completion of recuperation, as shown in FIG. 4, the rolling reduction is applied to polar opposites 2 in the opposite directions by rolling reduction rolls 12 so as to set a reduction ratio r ($r=(1-D2/D1)\times 100(\%)$, wherein D1: middle point distance between polar opposites on an inlet side of reduction roll, D2: middle point distance between polar opposites on an exit side of reduction roll) which is a shrinkage ratio of an middle point distance between polar opposites (a length of a line segment obtained by connecting middle points of K1, K2 in FIG. 2) to exceeding 0% and 5% or less. Although the explanation has been made with respect to the case where the rolling reduction step is performed after the completion of the local cooling step in FIG. 3, the rolling reduction step may be performed in the course of the local cooling step.

Figure 5:
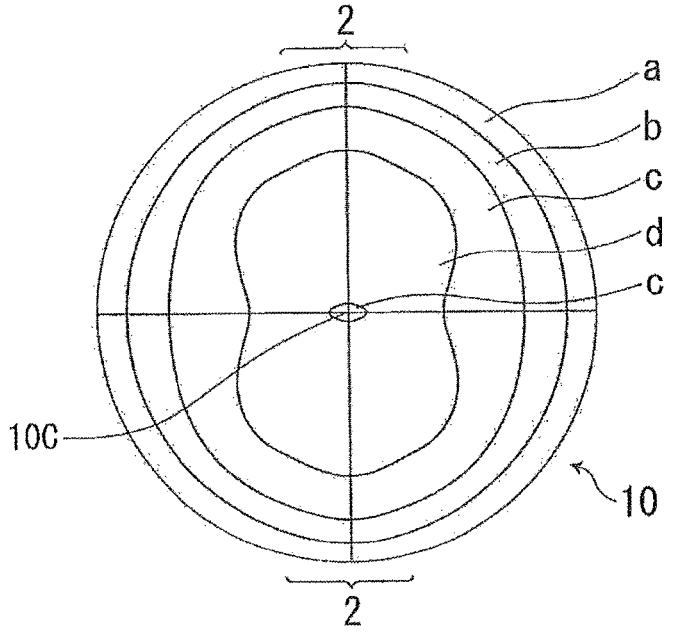
FIG. 5 is a stress distribution in the cross section of cast product showing an example of stress field immediately before the rolling reduction.
Figure 6:
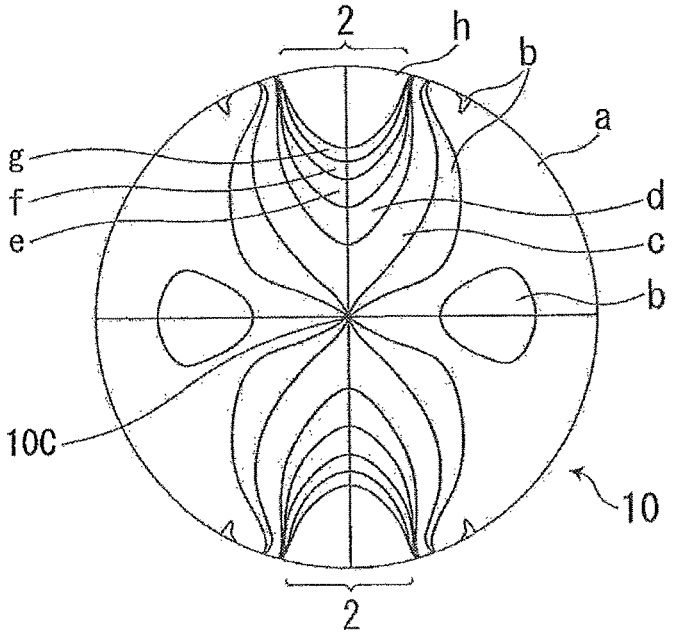
FIG. 6 is a stress distribution in the cross section of cast product showing an example of stress field immediately after the rolling reduction.

By combining the local cooling step and the rolling reduction step described above, for example, the tensile stress field directed in the opposite directions of polar opposites shown in FIG. 5 which is generated in the above-mentioned local cooling step can be converted into the compression stress field as shown in FIG. 6 which substantially covers the whole cross-section of the cast product by the above-mentioned rolling reduction step, for example. Accordingly, it is possible to largely improve quality of the axial core area. FIG. 5 and FIG. 6 are stress distributions in the cross section of the cast product showing an example of stress field immediately before and after the rolling reduction. These stress distributions are obtained by a simulating calculation using an FEA (finite element analysis) in a casting process in accordance with aspects of the present invention.

When any one or more of starting and stopping conditions, and the temperature deviation δ in the above-mentioned inhomogeneous forced cooling fall outside the scope defined by the present invention (1), there arise the following drawbacks. Firstly, the formation of the compressive stress field by cooling before recuperation which is a factor for sufficiently forming the tensile stress field directed in the opposite directions of polar opposites also becomes insufficient. Secondly, excessive cooling induces cracks as described previously. Accordingly, when any one or more of starting and stopping conditions, and the temperature deviation δ in the above-mentioned inhomogeneous forced cooling fall outside the scope defined by the present invention (1), it is difficult to enhance quality of the axial core area in the next rolling reduction step.

The above-mentioned inhomogeneous forced cooling can be easily carried out by spraying a relatively large amount of cooling medium such as water or air-water mixed fluid to polar opposites and by spraying a relatively small amount of such a cooling medium to remaining portions.

When the temperature deviation δ exceeds 30° C., cracks are liable to occur so that the larger reduction becomes necessary to suppress the occurrence of cracks. However, when the larger reduction is applied to the cast product, there may be a trouble that the temperature deviation δ adversely affects the shape of the cast product. Accordingly, it is preferable to set the temperature deviation δ to 30° C. or below.

When the rolling reduction by the rolling reduction rolls is performed in a temperature region outside the scope defined by the present invention (1), the enhancement of quality of the axial core area is insufficient. When the reduction ratio r is set to more than 5%, such an increase in the reduction ratio r not only brings about a defect on a shape of the round steel billet but also pushes up a facility cost. On the other hand, the smaller the reduction ratio r, a reduction effect is concentrated on only a surface layer so that it is difficult to acquire advantageous effects of the present invention. On the other hand, when the reduction ratio r is set to an excessively large value, the cost effectiveness is lowered. Accordingly, it is preferable to set the reduction ratio to 1% or more and 3% or less.

As the above-mentioned reduction roll, a grooved roll having a recessed portion (a large arc-like caliber having a depth of approximately 3 to 5 mm) used in general for preventing meandering can be used. A grooved roll having a recessed portion having a depth of approximately less than 3 mm or a flat roll may be also used. Although when a roll specifically designed for rolling reduction is used, the above-mentioned advantageous effect can be increased. However, the roll becomes a dedicated part and hence, aspects of the present invention are designed such that a sufficient effect can be obtained even when an ordinary roll is used from a viewpoint of cost reduction.

EXAMPLES OF THE INVENTION

Steps of manufacturing a round steel billet (product diameter: 210 mm) having a chemical composition shown in Table 1 (balance: Fe and unavoidable impurities) and a solidifying point Ts by continuous casting were simulated by FEA under the conditions of inhomogeneous forced cooling of cast product shown in Table 2 and rolling reduction using a grooved roll. In accordance with the simulation, inner quality of cast product immediately after rolling reduction was evaluated based on a density ratio (=density of cubic having a side size of 20 mm within the axial core area of cast product/density of cubic having a side size of 20 mm inside the outer peripheral portion of cast product) and, at the same time, presence or non-presence of cracks in the axial core area of cast product and good or bad shape of cast product were evaluated. A solidifying point was measured by heat analysis.

As shown in Table 2, in the present invention examples, the inner quality of cast product is favorable such that the density ratio of the axial core area is 0.95 or more. Further, no cracks occur in the axial core area, and also the good shape is obtained.

TABLE 1

| | Chemical Composition (Mass %) | | | | | | | Solidifying Point | |
|---|---|---|---|---|---|---|---|---|---|
| Steel | C | Si | Mn | P | S | Al | Cr | Ts (° C.) | Remarks |
| A | 0.2 | 0.25 | 0.45 | 0.01 | 0.002 | 0.020 | 12.90 | 1409 | 13Cr steel |
| B | 0.3 | 0.25 | 0.50 | 0.01 | 0.010 | 0.002 | 1.02 | 1440 | low Cr steel |

TABLE 2

| | | Inhomogeneous Forced Cooling of Cast Product | | | | Rolling Reduction | | | | | | |
|---|---|---|---|---|---|---|---|---|---|---|---|---|
| | | | | | | | Axial Core | | | | | |
| No. | Steel | Polar Opposites θ (Degree) | Center Solid-Phase Rate at The Time of Starting Cooling | Axial Core Temperature at The Time of Stopping Cooling (° C.) | Temperature Deviation δ (° C.) | Reduction Direction | Temperature at The Time of Performing Rolling Reduction (° C.) | Rolling Reduction (%) | Density Ratio at Axial Core Area | Presence or Non-Presence of Cracks in Axial Core Area | Shape of Cast Product | Remarks |
| 1 | A | 50 | 0.70 | Ts - 150 | 23 | A | Ts - 155 | 2.0 | 0.970 | not present | good | present invention example |
| 2 | A | 80 | 0.50 | Ts - 120 | 20 | A | Ts - 120 | 5.0 | 0.987 | not present | good | present invention example |
| 3 | A | 90 | 0.75 | Ts - 100 | 24 | A | Ts - 105 | 3.0 | 0.974 | not present | good | present invention example |
| 4 | A | 115 | 0.72 | Ts - 180 | 13 | A | Ts - 180 | 3.0 | 0.982 | not present | good | present invention example |
| 5 | A | 85 | 0.80 | Ts - 150 | 22 | A | Ts - 150 | 3.1 | 0.951 | not present | good | present invention example |
| 6 | A | 85 | 0.75 | Ts - 170 | 27 | A | Ts - 170 | 3.4 | 0.962 | not present | good | present invention example |
| 7 | A | 85 | 0.75 | Ts - 160 | 24 | A | Ts - 170 | 2.9 | 0.958 | not present | good | present invention example |
| 8 | A | 85 | 0.75 | Ts - 160 | 25 | A | Ts - 162 | 4.2 | 0.965 | not present | good | present invention example |
| 9 | A | 80 | 0.70 | Ts - 150 | 18 | A | Ts - 155 | 7.0 | 0.991 | not present | bad | comparison example |

TABLE 2-continued

| | | Inhomogeneous Forced Cooling of Cast Product | | | | Rolling Reduction | | | | | | |
|---|---|---|---|---|---|---|---|---|---|---|---|---|
| | | | | | | | Axial Core | | | | | |
| No. | Steel | Polar Opposites θ (Degree) | Center Solid-Phase Rate at The Time of Starting Cooling | Axial Core Temperature at The Time of Stopping Cooling (° C.) | Temperature Deviation δ (° C.) | Reduction Direction | Temperature at The Time of Performing Rolling Reduction (° C.) | Rolling Reduction (%) | Density Ratio at Axial Core Area | Presence or Non-Presence of Cracks in Axial Core Area | Shape of Cast Product | Remarks |
| 10 | A | 90 | 0.30 | Ts + 10 | 30 | A | Ts - 0 | 3.0 | 0.890 | present | good | comparison example |
| 11 | A | 80 | 0.50 | Ts - 150 | 55 | A | Ts - 200 | 5.0 | 0.980 | present | good | comparison example |
| 12 | A | 125 | 0.60 | Ts - 150 | 9 | A | Ts - 160 | 4.0 | 0.965 | present | good | comparison example |
| 13 | A | 80 | 0.75 | Ts - 150 | 26 | B | Ts - 160 | 5.0 | 0.954 | present | good | comparison example |
| 14 | A | 30 | 0.50 | Ts - 200 | 42 | A | Ts - 150 | 3.0 | 0.939 | present | good | comparison example |
| 15 | B | 50 | 0.70 | Ts - 265 | 63 | A | Ts - 271 | 3.0 | 0.961 | present | good | comparison example |
| 16 | B | 60 | 0.50 | Ts - 200 | 30 | A | Ts - 205 | 2.0 | 0.979 | present | good | comparison example |

(Note)
Rolling Directions
A: Opposite directions of polar opposites
B: Opposite directions of remaining portions

REFERENCE SIGNS LIST

1 casting mold (continuous casting mold)
2 polar opposites
3 remaining portions
6 gas cutting point
7 gas torch
9 molten steel
10 cast product
10*c* axial core
11 plain including the transverse cross-section
12 rolling reduction roll

The invention claimed is:

1. A method of manufacturing a round steel billet by continuous casting comprising:

in a local cooling step, applying inhomogeneous forced cooling to a cast product during the continuous casting in such a manner that the inhomogeneous forced cooling cools polar opposites on an outer periphery of the cast product more strongly than remaining portions of the cast product other than the polar opposites, the inhomogeneous forced cooling is started at a point of time within a terminal period of solidification and is stopped when a temperature of an axial core falls within a temperature range from a temperature below a solidification point to the solidification point minus 190° C., and a temperature deviation δ which is a maximum value of surface temperature difference between the polar opposites and the remaining portions at the time of completion of recuperation after the forced cooling is stopped is set to 10° C. or above; and in a rolling reduction step, applying rolling reduction to the cast product in the opposite directions of the polar opposites by reduction rolls in the course from the completion of solidification to the completion of the recuperation of the cast product so that rolling reduction r which is a reduction ratio of a distance between middle points of the polar opposites is set to a value exceeding 0% and 5% or less;

wherein polar opposites on the outer periphery indicate both an outer periphery which intersects with an angle domain having a center angle θ exceeding 0 degree and 120 degrees or less about an axial core in a plane including a transverse cross-section of the cast product, and an outer periphery which intersects with an angle domain obtained by rotating the angle domain by 180 degrees about the axis core; and wherein the terminal period of solidification is a period where a solidification rate at the center becomes 0.5 or more and 1.0 or less.

2. The method of manufacturing a round steel billet according to claim 1, wherein the temperature deviation δ is set to 30° C. or below.

3. The method of manufacturing a round steel billet according to claim 2, wherein the rolling reduction r is set to 1% or more and 3% or less.

4. The method of manufacturing a round steel billet according to claim 1, wherein the rolling reduction r is set to 1% or more and 3% or less.

* * * * *